US005174474A

United States Patent [19]

Tammi et al.

[11] Patent Number: 5,174,474

[45] Date of Patent: Dec. 29, 1992

[54] PAINT TONING MACHINE

[75] Inventors: Anssi Tammi, Vanha-Ulvila; Raimo Rehula, Noormarkku, both of Finland

[73] Assignee: Cimcorp Oy, Ulvila, Finland

[21] Appl. No.: 730,219

[22] Filed: Jul. 15, 1991

[30] Foreign Application Priority Data

Aug. 8, 1990 [FI] Finland ..... 903924

[51] Int. Cl.[5] ..... B65D 35/28

[52] U.S. Cl. ..... 222/94; 222/325; 222/67; 222/318; 141/18

[58] Field of Search ..... 222/94, 95, 105, 107, 222/103, 386.5, 325, 66, 67; 141/18, 20

[56] References Cited

U.S. PATENT DOCUMENTS 3,992,706 11/1976 Tunney et al. ..... 222/66 X
4,226,267 10/1980 Meacham, Jr. ..... 141/18
4,526,191 7/1985 Pomponi, Jr. ..... 222/144.5 X
4,551,139 11/1985 Plaas et al. ..... 222/105 X
4,576,313 3/1986 Smith et al. ..... 141/18 X
4,601,409 7/1986 DiRegolo ..... 222/67 X
4,792,059 12/1988 Kerner et al. ..... 222/67
4,898,303 2/1990 Large et al. ..... 222/66 X

*Primary Examiner*—Andres Kashnikow
*Assistant Examiner*—Kenneth DeRosa
*Attorney, Agent, or Firm*—Scully, Scott, Murphy & Presser

[57] ABSTRACT

The object of the invention is a paint toning machine comprising at least one paste container (4, 5) for keeping toning paste and means (1, 2) attached to the paste container for dispensing the paste. To avoid drying of the toning paste in the paste container the paste container is essentially gas-tight and airless and comprises an intermediate container (4) of elastic material, such as plastic, and a replaceable refill container (5) likewise of elastic material, such as plastic, the refill container being connected to the intermediate container in such a way that the interiors of the containers are in contact with each other, both parts of the paste container being compressible and the volume of the interior of the paste container essentially corresponding to the amount of paste in the container at any given time.

7 Claims, 1 Drawing Sheet

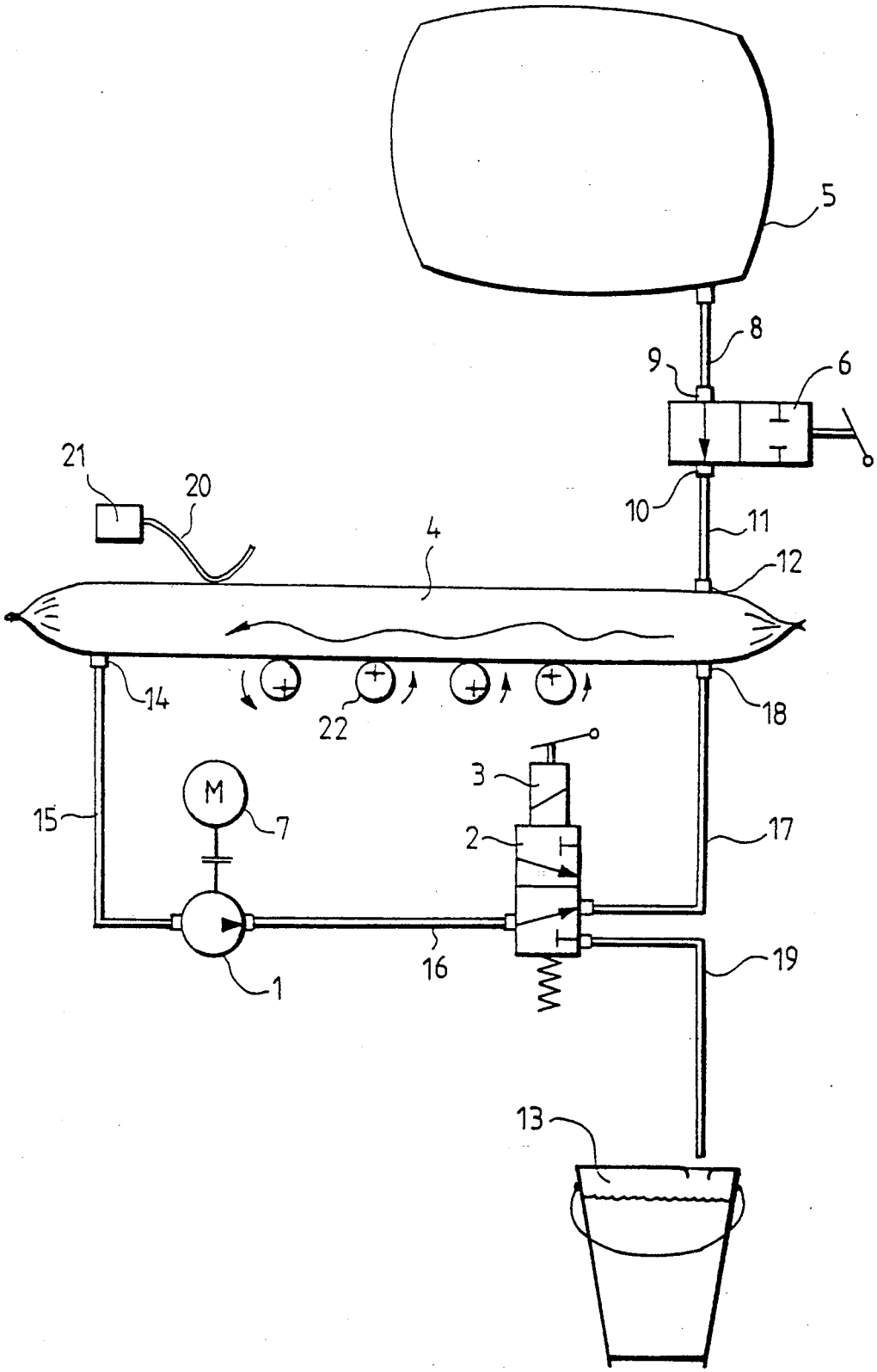
5
8
9
6
21
20
10
11
4
12
14
22
18
3
M
7
15
2
17
16
19
1
13

PAINT TONING MACHINE

This invention relates to a paint toning machine comprising at least one paste container for keeping toning paste and means attached to the paste container for dispensing the paste.

In paint toning machines toning pastes of various types are used, the pastes being either water-thinned or solvent-thinned. It is common to all colour pastes that they dry rather easily when they come into contact with air. Some colour pastes may even deteriorate when they come into contact with air. In typical paint toning machines, however, colour pastes are placed in containers that contain a greater or smaller amount of air depending on the amount of paste in the container. When solvent-thinned colour pastes are concerned, the air in the container is saturated fairly quickly with solvent fume whereby drying is essentially inhibited. The problem is, however, the tightness of the containers in other respects, since on the one hand the containers should allow fresh air to enter the container as paste is dispensed therefrom but on the other hand they should not leak solvent fumes for reasons of health and especially of fire protection.

The object of the present invention is to provide a paint toning machine in which the above problems of the known paint toning machines have been eliminated. This is achieved by means of a paint toning machine according to the invention, which is characterized in that the paste container comprises a compressible container of elastic material, such as plastic. Particularly advantageously the paste container is essentially gas-tight and airless and comprises an intermediate container of elastic material, such as plastic, and a replaceable refill container likewise of elastic material, such as plastic, which is connected to the intermediate container in such a way that the interiors of the containers are in contact with each other, both parts of the paste container being compressible and the volume of the interior of the paste container essentially corresponding to the amount of paste in the container at any given time. By means of the compressible intermediate container that can be closed in an airtight manner the paste is always kept in an airless space and the volume of the paste container is adjusted to the amount of paste in the container at any given time and it is not necessary to introduce air into the container to replace the paste dispensed. Thereby drying of the paste is inhibited completely and the risk of leaking any solvents present in the paste is also avoided.

Preferably a valve is fitted between the intermediate container and the refill container to open and close a connection therebetween especially when the refill container is replaced. The most practical alternative is that the valve comprises means for opening a connecting aperture to the refill container when the container is connected to the intermediate container.

Thus, in the paint toning machine according to the invention part of the paste container can be formed by a replaceable compressible refill bag or refill container of elastic plastic material which is replaced with a new full container when empty. Preferably the refill container is placed above the intermediate container to make the paste transfer gravitationally from the refill container to the intermediate container. Thereby the emptying of the refill container can be simply and effectively detected with means which is attached to the intermediate container and detects the compression thereof. In this kind of arrangement the intermediate container does not begin to be compressed until the refill container is completely empty. This is a simple and effective way of detecting the emptying of the refill container and avoiding the risk that the paste container would empty completely during dispensation.

In the following the paint toning machine according to the invention will be described in more detail by way of example by means of an embodiment thereof with reference to the attached drawing wherein the FIGURE provides a schematic view of one paste container of the paint toning machine according to the invention with means attached thereto.

The FIGURE shows an arrangement for one colour paste of the paint toning machine according to the invention for both keeping of paste and dispensation thereof. It is to be understood that a conventional paint toning machine comprises a plurality of such arrangements, one for each colour paste needed. The arrangement shown in the FIGURE for keeping of paste and dispensation thereof when necessary to a vessel 13 containing basic paint to be toned through an aperture made on the cover thereof comprises a paste container formed by a refill container 5 and an intermediate container 4 and means attached to the intermediate container 4 for dispensation of the paste. Both the refill container 5 and the intermediate container 4 are of elastic material, such as plastic, the strength and composition of material whereof can be selected in line with the requirements of the type of paste that is to be used in the machine. The refill container 5 is a bag-like completely closed container to which a connection piece 8 presented as a tubular connection hose in the embodiment of the FIGURE is attached. The interior of this hose in the solution described is in direct contact with the interior of the bag 5 and closed only with a film fitted at the end of the hose 8. The intermediate container 4 is described as a tubular elongated bag closed at the ends thereof by puckering. The refill container 5 is connected to the intermediate container 4 in such a way that the interiors of the containers are in contact with each other. This contact is effected through the above-mentioned hose connection 8 and a connector 9 at the end thereof to a connecting valve 6 and from there through a connector 10 to a hose 11, which in turn is connected through a connector 12 to the intermediate container 4. When the valve 6 is open, the interiors of the containers 4 and 5 are in direct contact with each other. The container 5 is placed above the container 4 in such a way that the paste in the container 5 runs gravitationally to the container 4 as paste is dispensed from the container 4. Preferably the connecting valve 6 has such a structure that when it is moved to a position effecting contact it also cuts the film closing the refill bag 5, whereby the paste is free to run from the bag 5 to the container 4.

Dispensation from the intermediate container 4 is effected in a fairly conventional manner. For this a pipe connection 15 is attached to the intermediate container 4 by a connector 14, the pipe connection having a pump 1, such as a gear-type pump, driven by a motor 7 optionally through a gear system. From this pump the paste transfers through a pipe connection 16 and a valve 2 operated both manually and with a magnet coil 3 either through a pipe connection 19 to a vessel 13 containing basic paint to be toned or through a pipe connection 17 and a connector 18 back to the intermediate container 4. Thus the paste can be recirculated through the connection 17 to the intermediate container to keep it suitably viscous.

In the solution shown in the FIGURE four shafts 22 eccentrically mounted in bearings are fitted below the intermediate container 4 in connection therewith, and by twisting the shafts the paste in the intermediate container 4 can be stirred to keep it homogenous. Further, the container 4 is connected with a detecting element, such a microswitch 21 provided with a detecting spring 20, which detects the compression of the intermediate container. The compression begins when the refill container 5 has emptied and no more paste runs therefrom to the intermediate container and dispensation from the intermediate container 4 begins. Thus, with the detecting element 21 it is possible in a very simple and effective way to observe the compression of the intermediate container when it begins to empty and above all to receive information about the emptying of the refill container and thereby replace it with a new refill container in good time before the risk arises that even the intermediate container might become empty. When the refill container 5 is replaced the valve 6 is naturally closed, whereby air cannot enter the intermediate container 4. Since the refill container 5 is also quite full and consequently airless when it is connected with the valve 6, the whole paste container, which is formed by the refill container 5 and the intermediate container 4, is kept completely airless in all steps of operation of the paint toning machine according to the invention.

The paint toning machine according to the invention has been described above only by way of example by means of one structural solution and it is to be understood that the idea according to the invention concerning a compressible paste container could be applied in many other ways than in the way illustrated by the FIGURE. In the simplest embodiment the paste container can be formed by only one compressible container, which can be either fixed to the machine whereby a valve through which the container can be filled and by which it can be closed in an airtight manner is attached thereto, or be separate from the machine whereby it is formed by a replaceable bag essentially corresponding to the refill container 5. When the container is a fixed container the filling can be carried out either by pouring from a pot or by attaching such a refill pot to the valve for as long as it takes from the paste to run from the pot into the container. Naturally, the volume of the vessel from which the container is filled can be so great as to suffice for more than one refill of the container. One alternative structural solution is an application in which the dispensing pump is placed within the container 4. Thereby the valve conducting the paste to the circulation conduit or alternatively to dispensation could be placed within the container like the circulation conduit itself, whereby the container 4 would form a whole optionally comprising two bags at least partly within each other.

We claim:

1. A paint toning machine comprising at least one paste container (4,5) for keeping toning paste and means (1,2) attached to the paste container for dispensing the paste wherein the paste container (4,5) is essentially gas-tight and airless and comprises an intermediate container (4) of elastic material and a replaceable refill container (5) of elastic material, the replaceable refill container being connected to the intermediate container in such a way that the interiors of the containers are in contact with each other, the refill container supplying toning paste to the intermediate container and the intermediate container supplying paste to the dispensing means both the intermediate container and the replacement refill container of the paste container being compressible, and the volume of the interior of the paste container essentially corresponding to the amount of paste in the paste container at any given time.

2. A paint toning machine according to claim 1, characterized in that a valve (6) is fitted between the intermediate container (4) and the refill container (5) so as to open and close a connection therebetween especially when the refill container (5) is replaced.

3. A paint toning machine according to claim 2, characterized in that the valve (6) comprises means for opening a connecting aperture in the refill container (5) to communicate with the intermediate container (4).

4. A paint toning machine according to claim 3, characterized in that the refill container (5) is placed above the intermediate container (4) to make the paste transfer gravitationally from the refill container (5) to the intermediate container (4).

5. A paint toning machine according to claim 4, characterized in that the paste container (4,5) is connected with means (20,21) for detecting the compression thereof.

6. A paint toning machine according to claim 1, characterized in that the elastic material of the intermediate container is plastic.

7. A paint toning machine according to claim 1 characterized in that the elastic material of the replacement refill container (5) is plastic.

* * * * *